US005291244A

United States Patent [19]

Kajiwara et al.

[11] Patent Number: 5,291,244

[45] Date of Patent: Mar. 1, 1994

[54] IMAGE FORMING APPARATUS COMMUNICATION SYSTEM

[75] Inventors: Junichi Kajiwara, Nara; Shigeharu Maehara, Ikoma, both of Japan

[73] Assignee: Sharp Kabushiki Kaisha, Osaka, Japan

[21] Appl. No.: 58,646

[22] Filed: May 7, 1993

[30] Foreign Application Priority Data

May 15, 1992 [JP] Japan ..... 4-123523

[51] Int. Cl.[5] ..... G03G 21/00

[52] U.S. Cl. ..... 355/202; 355/204

[58] Field of Search ..... 355/200, 202, 204, 205, 355/206, 207, 208; 358/296, 300; 364/138, 514, 550; 395/200

[56] References Cited

U.S. PATENT DOCUMENTS 4,390,953 6/1983 Johnstone ..... 364/138 X
4,583,834 4/1986 Seko et al. ..... 355/206
4,788,637 11/1988 Tamaru ..... 395/200 X
4,999,672 3/1991 Rice, Jr. et al. ..... 355/202
5,077,582 12/1991 Kravette et al. ..... 355/206
5,184,179 2/1993 Tarr et al. ..... 355/206
5,200,778 4/1993 Ito ..... 355/204

FOREIGN PATENT DOCUMENTS 5-6270 1/1993 Japan .

*Primary Examiner*—A. T. Grimley
*Assistant Examiner*—Sandra L. Brase
*Attorney, Agent, or Firm*—David G. Conlin; Robert F. O'Connell

[57] ABSTRACT

A copying machine communication system is arranged so as to form a network by connecting a plurality of copying machines including ROMs which respectively store programs of various versions and a host computer in a service station through a public telephone line. This enables a serviceman in the service station to confirm the program version of the copying machine installed in a user's place, thereby permitting the serviceman to offer a prompt and efficient service.

12 Claims, 4 Drawing Sheets

IMAGE FORMING APPARATUS COMMUNICATION SYSTEM

FIELD OF THE INVENTION

The present invention relates to an image forming apparatus communication system wherein an image forming apparatus such as an electrophotographic printing machine and a host device in a service station are connected.

BACKGROUND OF THE INVENTION

In an electrophotographic printing machine, each of a plurality of control boards includes thereon a ROM (Read Only Memory) storing therein a program for controlling each component. As time passes, the program stored in the ROM may be partially changed due to the change in the specification, etc., in order to flexibly cope with the problems or market demand which could not be predicted when the copying machine was developed. In this way, increase in the value of the device can be achieved by altering it to always meet the current specification. For example, when the components to be exchanged of the device have changed, or the life of the component becomes longer because the durability thereof is improved, for example, by the improvement of the material quality, the maintenance control counter is changed for reducing the user's expense.

When the program stored in the ROM is partially changed, as to the newly produced products, the ROM is exchanged with that of new version when producing. However, as to the products already forwarded into the market from the manufacturer, a serviceman must visit the individual customer to exchange the ROM with that of new version.

In addition, the program may be changed in order to add special function. In such a case, because some users may not want the function, even if the program is changed after the copying machine was forwarded into the market, the ROM in the copying machine may not be exchanged with that of new version if not desired.

This means that if the program in the ROM is changed many times after the mass-production of the original copying machine has started, the copying machines with ROMs of various versions exist in the market.

Therefore, it is difficult for the serviceman to carry out the maintenance operation of the copying machines. Because the serviceman does not know which version of program is used for operating the copying machine, a long time is required for a subtle adjustment, thereby presenting the problem of low operating efficiency. In order to counteract this, normally, the control number is written on the surface of the ROM whenever the program is changed in order to control the program version. In this way, the subtle adjustment in the individual process is carried out based on the control number.

However, in order to confirm the program version of the copying machine, the serviceman must visit the customer and remove the cover of the copying machine to expose the control board. Because the serviceman in the service station would not know exactly what service is required before visiting the customer, the serviceman must visit the customer at least twice: first visit is to confirm the program version, and the second visit is to carry out the maintenance operation with the necessary components and tools for the required service. Otherwise, the serviceman must bring various kinds of components and tools so as to manage the all possible situations. Because such a troublesome work is required for the serviceman, the problem arises in that the serviceman cannot offer a prompt service, or too much work is required for the serviceman.

SUMMARY OF THE INVENTION

An object of the present invention is to provide an image forming apparatus communication system which enables a serviceman in a service station to confirm a program version of an image forming apparatus installed in a user's place, and which enables a prompt and efficient service and a sufficient reduction in a serviceman's load.

In order to achieve the above object, the image forming apparatus communication system of the present invention is characterized by including:

an image forming apparatus including control means for controlling operations of the image forming apparatus based on a program stored therein;

a host device which includes input means and display means, for giving the image forming apparatus an instruction corresponding to an input from the input means, and for displaying on the display means an information based on an information signal received from the image forming apparatus; and communication means for communicating between the image forming apparatus and the host device, and wherein the image forming apparatus includes means for transmitting an information signal indicating a program version of the control means to the host device through the communication means based on the instruction from the host device received through the communication means.

The above arrangement enables a communication between the image forming apparatus and the host device through the communication means. More concretely, a serviceman (operator) operates the input means of the host device so that a request is given to the image forming apparatus for the information regarding the program version. As a result, an information signal indicating the program version is transmitted to the host device through the communication means. Then, the host device activates the display means to display an information based on the information signal received from the image forming apparatus.

This permits a serviceman in a place where the host device is installed (service station) to confirm the program version of the image forming apparatus installed in a remote place (user's place), thereby enabling the serviceman to offer a prompt and sufficient service.

Further, in order to achieve the above object, another image forming apparatus communication system in accordance with the present invention having the above arrangement is characterized in that a plurality of image forming apparatuses are connected to the host device through the communication means so as to form a network.

The above arrangement enables respective program versions of a plurality of image forming apparatuses to be easily controlled. For example, when an alternation of the program is required, the place where the object image forming apparatus is installed is promptly identified only by operating the input device of the host device. Without the image forming apparatus communication system of the present invention, a serviceman must visit the place where the image forming apparatus is installed and remove the cover of the apparatus to expose the control board whenever a problem arises for all the image forming apparatuses in the market. Considering the above troublesome work, the image forming apparatus communication system permits a significant reduction in a serviceman's load.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a block diagram showing an arrangement of essential parts of a copying machine communication system.

FIG. 2 is a view showing a schematic configuration of a copying machine adopted in the copying machine communication system of FIG. 1.

FIG. 3 is a block diagram of the components of the copying machine communication system of FIG. 1.

FIG. 4 is an explanatory view showing a process for up-loading an information identifying a program version of the copying machine in the copying machine communication system of FIG. 1.

DESCRIPTION OF THE EMBODIMENTS

The following description will discuss one embodiment of the present invention with reference to FIGS. 1 through 4.

Figure 1:
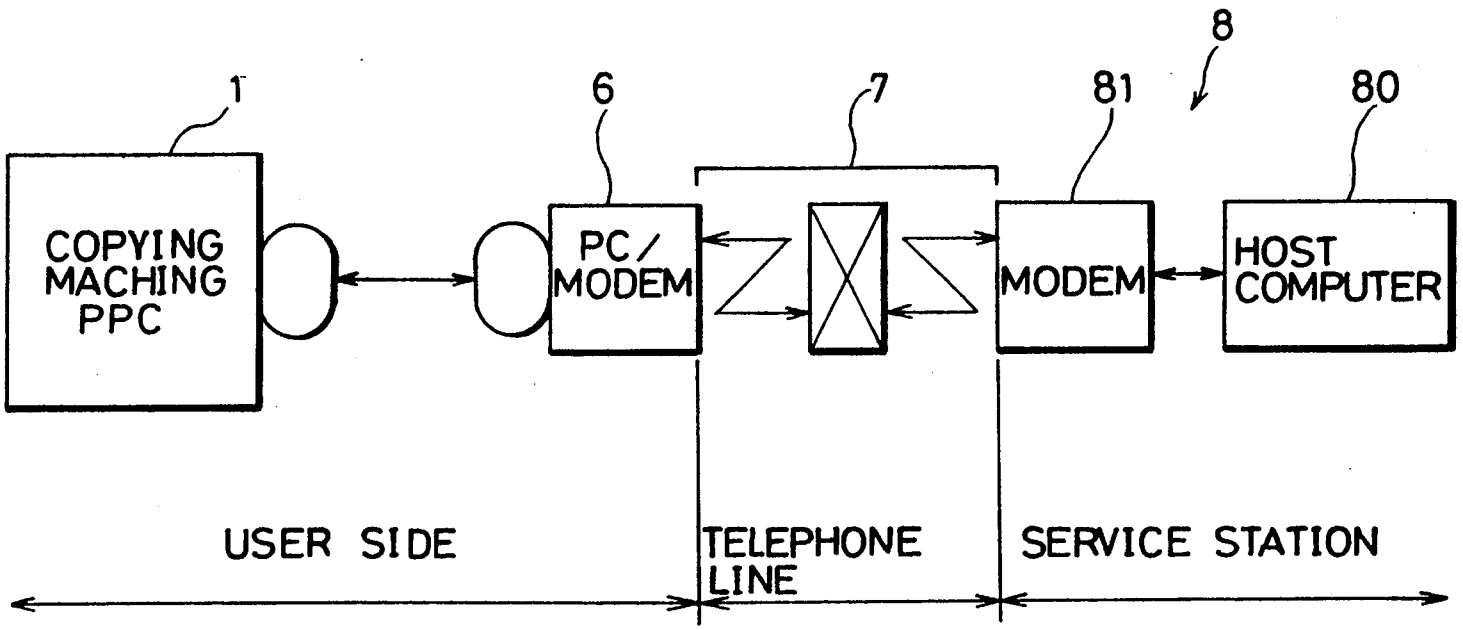
FIGS. 1 through 4 show an embodiment of the present invention.

FIG. 1 shows a configuration of a copying machine communication system (image forming apparatus communication system) of the present embodiment. A copying machine 1 (image forming apparatus) installed in a user's place is connected to a public telephone line 7 (communication line, analog line) through a PC/modem 6 (first connection means). A host computer 80 (host device) in a service station 8 is connected to the public telephone line 7 through a modem 81 (second connection means, second signal conversion means). The PC/modem 6 with an automatic dial function stores an information regarding a telephone number for calling the host computer 80 in the service station 8.

In the present embodiment, the communication means is composed of the PC/modem 6 (first connection means), the public telephone line 7 (communication line), and the modem 81 (second connection means). However, the present invention is not limited to this arrangement. For example, a digital line is preferably used for the communication line as well.

Figure 2:
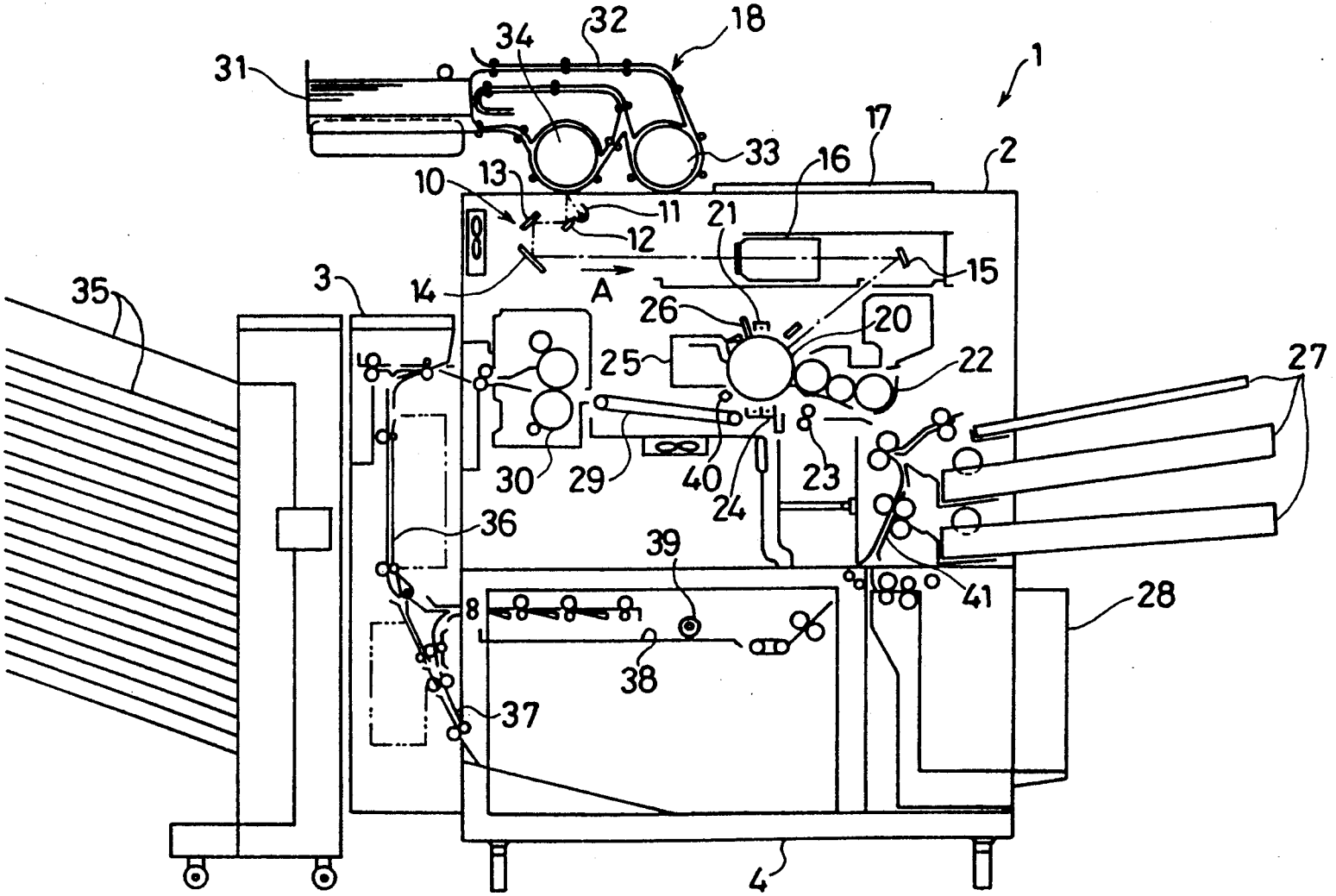

FIG. 2 shows a configuration of the copying machine 1. The copying machine 1 is mainly composed of a main body 2, a sorter 3, and a base 4.

As shown in FIG. 2, an optical system 10 is provided in an upper part of the main body 2. The optical system 10 includes a copy lamp 11 composed of a halogen lamp, etc., first through fourth mirrors 12 - 15, and a zoom lens 16.

A photoreceptor 20 is rotatively provided under the optical system 10. Along the circumference of the photoreceptor 20, a charger 21, a developer unit 22, a transfer unit 24, a cleaner 25, an eraser 26, etc., are provided in the order of copying process.

Further, a document platen 17 and an automatic document feed unit 18 are provided on the main body 2. The automatic document feed unit 18 includes a section 31 for setting the document, a document transport path 32, and a pair of drums 33 and 34. When the automatic document feed unit 18 is adopted, a copying operation is carried out by projecting a light onto a document from the copy lamp 11 while rotating the drum 33 (34) with the document fed from the section 31 for setting the document wound round thereon. In this case, a first mirror base including the copy lamp 11 and the first mirror 12 is held under the drum 33 (34).

The base 4 is provided with a feed unit 28, and an intermediate tray 38 placed within the base 4. The feed unit 28, which is capable of storing a plurality of copying materials, is provided for feeding a copying material to the main body 2. Further, the sorter 3 is provided with a discharge tray 35 with a plurality of stages, and transport paths 36 and 37 placed therein. The transport path 36 connects the main body 2 and the intermediate tray 38 in the base 4. The transport path 37 is provided for reversing the copying material to be discharged onto the intermediate tray 38.

The copying material is fed into the main body 2 from a plurality of feed trays 27 in the main body 2 or the feed unit 28 in the base 4. The copying material fed into the main body 2 is transported between the photoreceptor 20 and the transfer unit 24 in synchronous with a copying process by a register roller 23. After passing between the photoreceptor 20 and the transfer unit 24, the copying material is transported to a fuser 30 by a transport unit 29. Thereafter, the copying material is fed to the sorter 3.

As to a copying operation, a copying process, a document scanning, and operations of environmental devices, etc., are carried out with a control of a master CPU (Central Processing Unit) (to be described later). When a copy button (not shown) is pressed, the first mirror base including the copy lamp 11 and the first mirror 12, and the second mirror base including the second mirror 13 and the third mirror 14 are moved in the direction of an arrow A shown in FIG. 2. Then, light is projected onto a document (not shown) placed on a document platen 17 from the top end, the document being covered by a document cover (not shown). A light reflected from the document is directed to the photoreceptor 20 by the first through fourth mirrors 12–15. As a result, the surface of the photoreceptor 20, being charged to be a predetermined potential by the charger 21, is exposed, thereby forming a static latent image corresponding to an image on the document on the surface of the photoreceptor 20.

The static latent image is developed by a toner supplied from the developer unit 22 so as to form a toner image on the surface of the photoreceptor 20. The toner image is moved to the transfer unit 24 by the rotations of the photoreceptor 20. In this stage, the copying material is transported between the photoreceptor 20 and the transfer unit 24 at a predetermined timing by the register roller 23. As a result, the toner image is transferred onto the copying material by the transfer unit 24.

Then, the copying material is separated from the photoreceptor 20, and transported to the fuser 30 by the transport unit 29 where the toner image is permanently affixed to the copying material. The copying material discharged from the fuser 30 is transported to the sorter 3.

When a selected copying mode is a single copying mode, or when the second copying process is carried out in the both-sided or composite copying mode, the copying material fed to the sorter 3 is discharged onto a predetermined stage of the discharge tray 35. On the other hand, when the first copying process is carried out in the both-sided or composite copying mode, the copying material fed to the sorter 3 is transported to the transport path 36 in the sorter 3. Thereafter, in the case of the composite copying mode, the copying material is directly discharged onto the intermediate tray 38. In the case of the both-sided copying mode, the copying material is discharged onto the intermediate tray 38 after being reversed through the transport path 37.

After a predetermined number of copying materials are piled on the intermediate tray 38, the copying materials are taken out one by one from the top by a feed roller 39. The copying materials are transported back to the register roller 23 through the transport path 41. Thereafter, the second copying process of the both-sided or composite copying modes is carried out.

Figure 3:
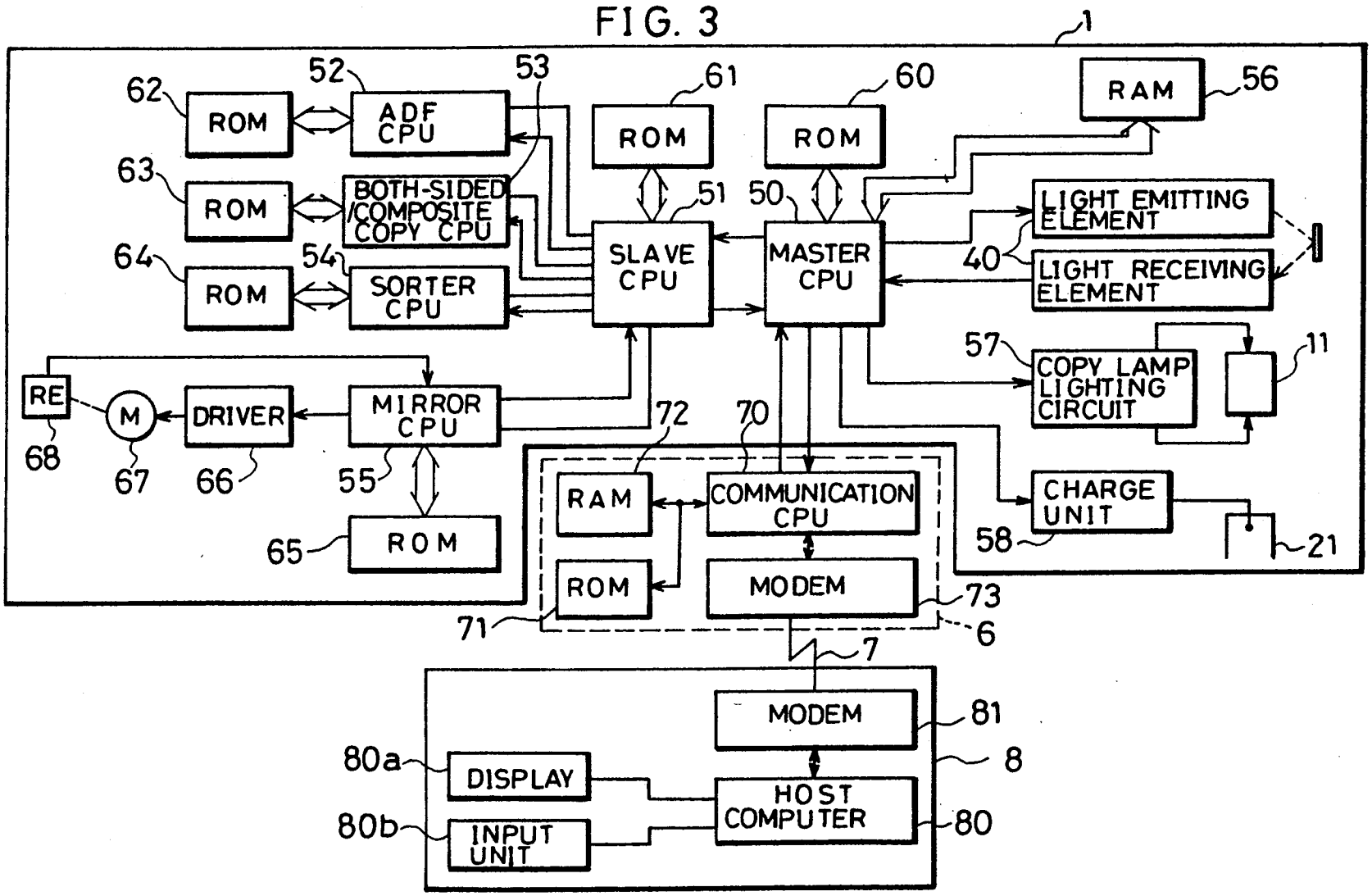

As shown in FIG. 3, the copying machine 1 is provided with a master CPU 50 (processing means, main control means) and a slave CPU 51 (processing means, first sub-control means). The master CPU 50 controls the copying process and the operations of the entire device. The master CPU 50 also communicates with a communication CPU 70 of the PC/modem 6.

The slave CPU 51 controls various units of the copying machine 1 based on the command received from the master CPU 50. An ADFCPU 52 (processing means, second sub-control means) for controlling operations of the automatic document feed unit 18, a both-sided/composite copy CPU 53 (processing means, second sub-control means) for controlling operations of the transport unit such as the transport paths 36, 37, and 41, or the feed roller 39, etc., a sorter CPU 54 (processing means, second sub-control means) for controlling operations of the sorter 3, and a mirror CPU 55 (processing means, second sub-control means) for controlling operations of the optical system 10 are connected to the slave CPU 51.

The mirror CPU 55 controls rotations of a mirror motor 67 using a driver 66 based on the rotation speed data of the mirror motor 67 detected by a rotary encoder 68. With the rotations of the mirror motor 67, the first mirror base including the first mirror 12, and the second mirror base including the second and the third mirrors 13 and 14 are moved.

ROMs 60–65 (memory means) for storing therein respective programs are bus-connected to the CPUs 50–55. RAM (Random Access Memory) 56 which registers the data is bus-connected to the master CPU 50. Further, an optical sensor 40 composed of a light emitting element and a light receiving element, for detecting the density of an image, a copy lamp lighting circuit 57 for driving the copy lamp 11, and a charge unit 58 for supplying a high voltage to the charger 21 are connected to the master CPU 50.

The master CPU 50 executes the program stored in the ROM 60, and gives an instruction to the slave CPU 51 for operating each unit using a command based on signals from various keys or sensors. When the slave CPU 51 receives the command from the master CPU 50, the slave CPU 51 transmits a command to each unit to activate it according to the instruction from the master CPU 50. For example, when the mirror CPU 55 receives a command from the slave CPU 51, the mirror CPU 55 controls the movement of the first mirror base and the second mirror base from their home positions in the direction of an arrow A (see FIG. 2) or the movement back to their home positions.

The master CPU 50 controls the application/stoppage of the voltage to the copy lamp 11 through the copy lamp lightening circuit 57. The master CPU 50 also adjusts an effective voltage level to be applied to the copy lamp 11, and controls the voltage of various high voltage units such as the charge unit 58.

The ROM 60 of the master CPU 50 stores the following program: It is activated by receiving a request from the PC/modem 6, and a request is given to the slave CPU 51 for an information regarding the program versions stored in the ROMs 61–65 of the slave CPU 51 and the CPUs 52–55. Then, an information regarding the program version stored in one's own ROM 60 is added to the information regarding the program versions stored in the ROMs 61–65, and obtained from the slave CPU 51. Thereafter, the information is transmitted to the PC/modem 6.

The ROM 61 of the slave CPU 51 stores the following program: It is activated by receiving a request from the master CPU 50, and when a request is given to each of the CPUs 52–55, the information regarding the program versions stored in the ROMs 62–65 of the CPUs 52–55 is collected. Then, the information regarding the program version stored in one's own ROM 61 is added to the collected information regarding the program versions. Thereafter, the information is transmitted to the master CPU 50.

The ROMs 62–65 of the CPUs 52–55 for controlling respective units store the following program: It is activated by receiving a request from the slave CPU 51, and transmits the information regrading the program versions stored in one's own ROMs 62–65 to the slave CPU 51.

The PC/modem 6 includes a communication CPU 70, a ROM 71, and a RAM 72 which all serve as communication control means, and a modem 73 which serves as first signal conversion means. The communication CPU 70 is connected to the master CPU 50 of the copying machine 1, and is also connected to the ROM 71, the RAM 72, and the modem 73.

The modem 73 is connected to one end of the public telephone line 7. The modem 73 converts an analog signal transmitted through the public telephone line 7 into the digital signal, and sends it to the communication CPU 70. The modem 73 also converts the digital signal sent from the communication CPU 70 into the analog signal, and transmits it to the public telephone line 7.

The ROM 71 of the PC/modem 6 stores the program for controlling communication. The RAM 72 stores data regrading a telephone number, etc., for calling the host computer 80. The communication CPU 70 calls the host computer 80 in the service station 8 according to the program stored in the ROM 71, and responds the signal received from the host computer 80.

The ROM 71 of the PC/modem 6 stores the following program: It is activated by receiving a request from the host computer 80. Then, a command is transmitted to the master CPU 50 of the copying machine 1 for requesting an information regarding the program version. The information regarding the program version received from the master CPU 50 is transmitted to the host computer 80.

The PC/modem 6 (first connection means) employed in the present embodiment is arranged such that the communication CPU 70, the ROM 71, and the RAM 72 which all serve as communication control means, and the modem 73 which serves as first signal conversion means are integrated. The present invention is not limited to the above arrangement. For example, the PC/modem of the present invention may be arranged such that the communication control means and the first signal conversion means are provided as separate units. However, by adopting the first connection means wherein the communication control means and the first signal conversion means are integrated, the copying machine 1 is easily connected to the public telephone line 7.

The modem 81 provided between one end of the public telephone line 7 and the host computer 80 converts the analog signal transmitted through the public telephone line 7 into the digital signal, and transmit it to the host computer 80. On the other hand, the modem 81 converts a digital signal transmitted from the host computer 80 into an analog signal, and transmits it to the public telephone line 7.

The host computer 80 includes a display 80*a* and an input unit 80*b*. The host computer 80 gives an instruction to the copying machine 1 corresponding to the operation of the input unit 80*b* by the operator (serviceman). The host computer 80 also displays on the display 80*a* an information based on the information signal received from the copying machine 1.

Figure 4:
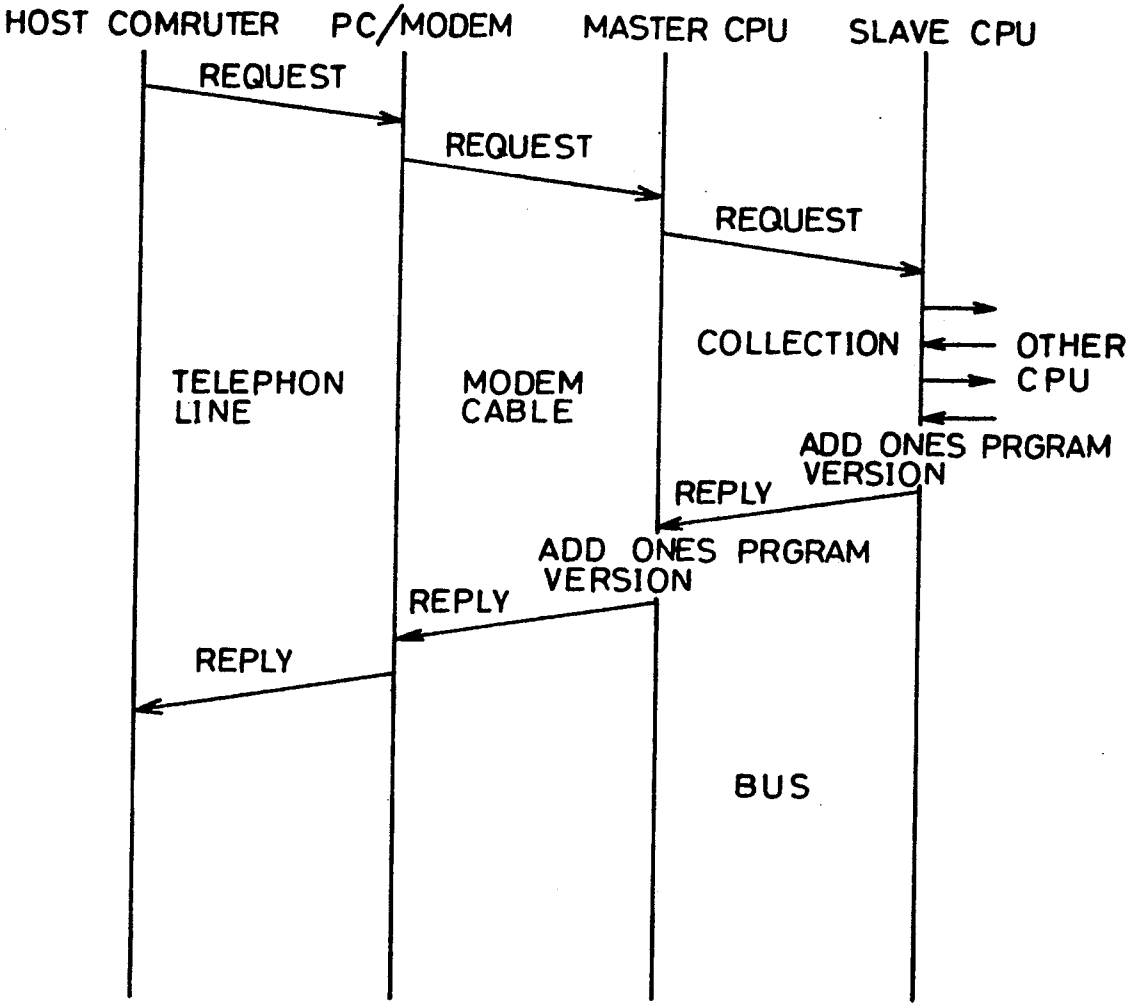

The following will explain the process for reading a program version in the service station 8, which is stored in the ROMs 60–65 of the copying machine 1 installed in a user's place (remote place) with reference to FIG. 4.

First, the serviceman in the service station 8 operates the input unit 80*b* of the host computer 80 so that a command is given to the PC/modem 6 which is connected to the copying machine 1 installed in the user's place for requesting the information regarding the program version, through the modem 81 and the public telephone line 7.

After receiving the command, the PC/modem 6 transmits a command to the master CPU 50 of the copying machine 1 for requesting the information regarding the program version.

Then, the master CPU 50 transmits a command to the slave CPU 51 for requesting the information regarding the program version.

After receiving the command, the slave CPU 51 transmits a command for requesting an information regarding the program versions to the CPUs 52–55 which respectively control the units.

Thereafter, the CPUs 52–55 which respectively transmit the information regarding the program version stored in one's own ROMs 62–65 to the slave CPU 51.

The slave CPU 51 collects the information regarding the program versions from the CPUs 52–55 which respectively control the units. Then, the information regarding the program version stored in one's own ROM 61 is added to the collected information. Thereafter, it is transmitted to the master CPU 50.

The master CPU 50 adds an information regarding the program stored in one's own ROM 60 to the information regarding the program version from the slave CPU 51. Thereafter, it is transmitted to the PC/modem 6.

The PC/modem 6 transmits the information regarding the program version from the master CPU 50 to the host computer 80 through the public telephone line 7 and the modem 81.

The host computer 80 displays the obtained information regarding the program version on the display 80*a*.

The above process enables the serviceman in the service station 8 to confirm the program version stored in the ROMs 60–65 of the copying machine 1 installed in a remote place.

The copying machine communication system of the present embodiment enables a prompt and efficient service by forming a network wherein a plurality of copying machines which include the ROMs 60–65 for storing programs of various versions and the host computer 80 in the service station 8 are connected through the public telephone line 7.

For example, when a serviceman in the service station 8 receives an inquiry from the user of the copying machine 1 regarding the copying machine 1 being out of order, by operating the host computer 80, the serviceman can confirm the program version of the copying machine 1 installed in the user's place without visiting there. This permits the serviceman to have good guess on what service is required from the content of the inquiry, and to bring the components, and the tools for the adjustment necessary for the required service to the user's place without mistakes. Therefore, the serviceman can offer a prompt and appropriate service in the user's place, thereby reducing the downtime period of the copying machine 1.

In the case where the ROMs 60–65 provided in the copying machine installed in the user's place are old, and is preferably replaced with the ROMs 60–65 of new version, the serviceman can bring the ROMs 60–65 of new version, and replace the old ROMs 60–65 with them. This enables the user to use the copying machine 1 in an optimal condition. As described, the serviceman can confirm the program version of the copying machine 1 installed in the user's place before visiting there, thereby permitting an attentive service which could not be offered conventionally.

Further, for example, when the life of the component becomes longer because the durability of the component to be exchanged is improved, the maintenance control counter is preferably changed. In this case, the program stored in the ROM is required to be changed for all the copying machines 1 in the market. If the version of the program related to the program to be changed is old, the ROM storing the program is required to be exchanged at the same time. In this case, the serviceman can confirm the program version of the copying machine 1 installed in the user's place before visiting there, weather or not any ROMs of old version to be exchanged exist in the copying machine 1 installed in the user's place can be determined. As a result, the serviceman can bring the necessary ROMs without mistake. Moreover, the serviceman need not visit the user's places where the exchange of ROMs is not required.

With the copying machine communication system of the present embodiment, when the serviceman in the service station 8 receives an inquiry from the user of the copying machine 1 indicating that the copying machine 1 is not operated according to the manual, the serviceman can appropriately manage the situation. This is because the serviceman can determine to some extent whether the cause is the bug on the program of the copying machine 1 or the wrong operation by the user by confirming the program version of the copying machine 1 installed in the user's place. More concretely, when the program of the copying machine 1 installed in the user's place is old, the most possible cause is the bug on the program. Thus, the serviceman immediately visits the user's place. On the other hand, when the program is that of new version, the most possible cause is the wrong operation by the user. Thus, the serviceman explains the manual to the user.

Moreover, by collecting the inquires from the users so as to correspond to the program version of the copying machine 1, the serviceman can grasp the market demand, and promptly manage the various situation in the market.

In the case where a special program is installed in the copying machine 1 of a major user only, so that, for example, the copying material of a special size can be adopted, the programs are changed individually. In such a case, the ROM may be changed only for the copying machines 1 having a special program. Even in such a case, with the copying machine communication system of the present embodiment, the serviceman in the service station 8 can promptly determine where the object copying machines are located, and can visits the place to exchange the ROM.

As described, the image forming apparatus communication system of the present invention is arranged so as to comprise:

an image forming apparatus including control means for controlling operations of the image forming apparatus based on a program stored therein;

a host device which includes input means and display means, for giving the image forming apparatus an instruction corresponding to an input from the input means, and for displaying on the display means an information based on an information signal received from the image forming apparatus; and communication means for communicating between the image forming apparatus and the host device, and wherein the image forming apparatus includes means for transmitting an information signal indicating a program version of the control means to the host device through the communication means based on the instruction from the host device received through the communication means.

This permits a serviceman in a place where the host device is installed (service station) to confirm the program version of the image forming apparatus installed in a remote place (user's place), thereby enabling the serviceman to offer a prompt and sufficient service.

Further, in order to achieve the above object, another image forming apparatus communication system in accordance with the present invention having the above arrangement is characterized in that a plurality of image forming apparatuses are connected to the host device through the communication means so as to form a network.

The above arrangement enables respective program versions stored in a plurality of image forming apparatuses to be easily controlled. For example, when an alternation of the program is required, the place where the object image forming apparatus is installed is promptly identified only by operating the input device of the host device. Without the image forming apparatus communication system of the present invention, a serviceman must visit the place where the image forming apparatus is installed and remove the cover of the apparatus to expose the control board for all the image forming apparatuses in the market. Considering the above troublesome work, the image forming apparatus communication system permits a significant reduction in a serviceman's load.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus communication system comprising:

an image forming apparatus including control means for controlling operations of said image forming apparatus based on a program stored therein;

a host device which includes input means and display means, for giving said image forming apparatus an instruction corresponding to an input from the input means, and for displaying on the display means an information based on an information signal received from said image forming apparatus; and communication means for communicating between said image forming apparatus and said host device, and wherein said image forming apparatus includes means for transmitting an information signal indicating a program version of the control means to said host device through said communication means based on the instruction from said host device received through said communication means.

2. The image forming apparatus communication system as set forth in claim 1, wherein:

the control means of said image forming apparatus includes memory means which stores therein the program, and processing means which executes the program.

3. The image forming apparatus communication system as set forth in claim 1, wherein:

said image forming apparatus is a copying machine.

4. The image forming apparatus communication system as set forth in claim 1, wherein said communication means includes:

a communication line;

first connection means, provided between said image forming apparatus and said communication line, for enabling a connection between said image forming apparatus and said communication line; and second connection means, provided between said host device and said communication line, for enabling a connection between said host device and said communication line.

5. The image forming apparatus communication system as set forth in claim 4, wherein said first connection means includes:

communication control means for transferring the information signal received from said host device through said communication line to said image forming apparatus, and for transferring the information signal received from said image forming apparatus to said host device through said communication line; and first signal conversion means, provided between said communication control means and said communication line, for converting the information signal transmitted from said communication control means and the information signal transmitted through said communication line so as to enable communication between said communication control means and said communication line, and said second connection means includes:

second signal conversion means, provided between said host device and said communication line, for converting the information signal transmitted from said host device and the information signal transmitted through said communication line so as to enable communication between said host device and said communication line.

6. The image forming apparatus communication system as set forth in claim 5, wherein:

said communication line is an analog line; and both of said first signal conversion means and said second signal conversion means include modulation-demodulation means having a function for modulating a digital signal into an analog signal, and a function for demodulating an analog signal into a digital signal.

7. The image forming apparatus communication system as set forth in claim 5, wherein:

the analog line is a public telephone line.

8. The image forming apparatus communication system as set forth in claim 5, wherein:

said communication control means includes memory means for storing information regrading a telephone number for calling said host device, and for automatically dialing to call said host device.

9. The image forming apparatus communication system as set forth in claim 4, wherein:

said communication line is a digital line.

10. The image forming apparatus communication system as set forth in claim 1, wherein the control means of said image forming apparatus includes:

main control means; and sub-control means being controlled by said main control means, said main control means including first transmission means for requesting said sub-control means for the information signal indicating a program version of said sub-control means, and for transmitting the information signal to said host device after adding an information signal indicating a version of one's program when receiving the instruction from said host device through said communication means, said sub-control means including second transmission means for transmitting the information signal indicating the version of one's program to said main control means when receiving the request from said main control means.

11. The image forming apparatus communication system as set forth in claim 10, wherein said sub-control means includes:

first sub-control means; and a plurality of second sub-control means being controlled by said first sub-control means for controlling an operation of each unit, said first sub-control means including third transmission means for requesting each of said plurality of second sub-control means for the information signal indicating a program version of each of said plurality of second sub-control means, and for transmitting the information signal to said main control means after adding the information signal indicating the version of one's program when receiving the instruction from said main control means, said plurality of second sub-control means including fourth transmission means for transmitting the information indicating the version of one's program to said first sub-control means when receiving the request from said first sub-control means.

12. The image forming apparatus communication system as set forth in claim 1, wherein:

a plurality of said image forming apparatuses are respectively connected to said host device through said communication means so as to form a network.

* * * * *